US010245456B1

(12) United States Patent
Peterson et al.

(10) Patent No.: US 10,245,456 B1
(45) Date of Patent: Apr. 2, 2019

(54) PROCESS FOR DECONTAMINATION AND DETOXIFICATION WITH ZIRCONIUM HYDROXIDE-BASED SLURRY

(71) Applicant: U.S. Army Edgewood Chemical Biological Center, Apg, MD (US)

(72) Inventors: Gregory W Peterson, Belcmap, MD (US); Joseph P. Myers, Havre de Grace, MD (US); George W Wagner, Elkton, MD (US); Matthew J. Shue, New Freedom, PA (US); John P Davies, Jr., North East, MD (US); Joseph A Rossin, Columbus, OH (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/178,958

(22) Filed: Nov. 2, 2018

Related U.S. Application Data

(62) Division of application No. 15/261,149, filed on Sep. 9, 2016, now Pat. No. 10,130,834.

(51) Int. Cl.

| | |
|---|---|
| ***A62D 3/36*** | (2007.01) |
| ***A62D 3/30*** | (2007.01) |
| *A62D 101/26* | (2007.01) |
| *A62D 101/04* | (2007.01) |
| *A62D 101/02* | (2007.01) |

(52) U.S. Cl.
CPC ..... *A62D 3/30* (2013.01); *A62D 2101/02* (2013.01); *A62D 2101/04* (2013.01); *A62D 2101/26* (2013.01)

(58) Field of Classification Search
CPC ..... A62D 3/36; A62D 3/30
USPC ..... 588/313
See application file for complete search history.

(56) References Cited

U.S. PATENT DOCUMENTS 10,130,834 B1 * 11/2018 Peterson ..... A62D 3/30

* cited by examiner

*Primary Examiner* — Edward M Johnson
(74) *Attorney, Agent, or Firm* — Ulysses John Biffoni

(57) ABSTRACT

The present invention is directed towards a composition for decontaminating surfaces contaminated with toxic chemicals/substances, comprising at least one type of metal oxyhydroxide such as zirconium hydroxide, $Zr(OH)_4$, optionally with added water for hydration of the solid, mixed into a carrier liquid used for application to a contaminated surface.

11 Claims, 2 Drawing Sheets

PROCESS FOR DECONTAMINATION AND DETOXIFICATION WITH ZIRCONIUM HYDROXIDE-BASED SLURRY

CROSS-REFERENCE TO RELATED APPLICATIONS

This application is a divisional of U.S. application Ser. No. 15/261,149 filed on Sep. 9, 2016, now U.S. Pat. No. 10,130,834, which is commonly assigned.

U.S. GOVERNMENT INTEREST

The invention described herein may be manufactured, used and licensed by or for the U.S. Government.

FIELD OF INVENTION

The invention relates to a suspension comprising reactive $Zr(OH)_4$ admixed with a carrier liquid, and a method of using the suspension for decontaminating and detoxifying surfaces that are contaminated with highly toxic compounds, including but not limited to chemical warfare agents (CWAs), toxic industrial chemicals, insecticides, and the like.

BACKGROUND OF THE INVENTION

Exposure to toxic agents, such as CW agents and related toxins, is a potential hazard to the armed forces and to civilian populations, since CW agents are stockpiled by several nations, and other nations and groups actively seek to acquire these materials. Some commonly known CW agents are bis-(2-chloroethyl)sulfide (HD or mustard gas), pinacolyl methylphosphonofluoridate (GD), Tabun (GA), Sarin (GB), cyclosarin (GF), and O-ethyl S-(2-diisopropylamino)ethyl methylphosphonothioate (VX), as well as analogs and derivatives of these agents, and any additional nerve or vesicant agents. These CW agents are generally delivered as fine aerosol mists which, aside from presenting an inhalation threat, will deposit on surfaces of military equipment and hardware, including uniforms, weapons, vehicles, vans and shelters. Once such equipment and hardware is contaminated with one of the previously mentioned highly toxic agents, the agent must be removed in order to minimize contact hazards.

For this reason, there is an acute need to develop and improve technology for decontaminating highly toxic materials. This is especially true for the class of toxic agents known as nerve agents, which are produced and stockpiled for both industrial use and as CW agents. One class of nerve agents with a high level of potential lethality is the class that includes organophosphorus-based ("OP") compounds, including, but not limited to, Sarin, Soman, and VX. Such agents can be absorbed through inhalation and/or through the skin of an animal or person. The organophosphorus-type ("OP") CW materials typically manifest their lethal effects against animals and people by inhibiting acetylcholine esterase ("AChE") enzyme at neuromuscular junctions between nerve endings and muscle tissue to produce an excessive buildup of the neurotransmitter acetylcholine, in an animal or person. This can result in uncontrollable spasms and death in a short time.

In addition to the concerns about CW agents, there is also a growing need in the industry for decontaminating industrial chemicals and/or insecticides, for example, AChE-inhibiting pesticides such as parathion, paraoxon and malathion, among others. Thus, it is very important to be able to effectively detoxify a broad spectrum of toxic agents, including, but not limited to, organophosphorus-type compounds, from contaminated surfaces and sensitive equipment.

Furthermore, CW agents and related toxins are so hazardous that simulants have been developed for purposes of screening decontamination and control methods. HD simulants include 2-chloroethylethyl sulfide (CEES) and 2-chloroethylphenyl sulfide (CEPS). G-agent simulants include dimethyl methyl phosphonate (DMMP). VX simulants include O,S-diethyl phenylphosphonothioate (DEPPT).

Currently, the U.S. Army uses a nerve agent decontamination solution called DS2, which is composed (by weight) of 2% NaOH, 28% ethylene glycol monomethyl ether, and 70% diethylenetriamine (Richardson, G. A. "Development of a package decontamination system," EACR-1 310-17, U.S. Army Edgewood Arsenal Contract Report (1972), incorporated by reference herein). Although this decontamination solution is effective against OP nerve agents, it is quite toxic, flammable, highly corrosive, and releases toxic by-products into the environment. For example, a component of DS2, namely diethylenetriamine, is a teratogen, so that the manufacture and use of DS2 also presents a potential health risk. DS2 protocol calls for waiting 30 minutes after DS2 application, then rinsing the treated area with water in order to complete the decontamination operation. The use of water in the operation presents logistics burdens, as now large volumes of water must be transported and stockpiled at the decontamination site.

The U.S. Army also uses M100 decontamination system (SDS) for decontaminating highly toxic materials. The M100 SDS utilizes an alumina-based material called A-200, which is a mixture of silica-alumina particles and activated carbon. Details of this system are provided in U.S. Pat. No. 6,852,903.

Another example is U.S. Pat. No. 5,689,038, to Bartram and Wagner, disclosing the use of an aluminum oxide, or a mixture of aluminum oxide and magnesium monoperoxyphthalate (MMPP), to decontaminate surfaces contacted with droplets of chemical warfare agents. It has been reported that both materials were able to effectively remove such toxic agents from a surface to the same extent as XE555. In addition, both materials represented improvements in chemical warfare agent degrading reactivity and in reducing off-gassing of toxins relative to XE555. Essentially, Bartram and Wagner reported that their aluminum oxide is modified by size reduction, grinding or milling.

Another example is U.S. Pat. No. 6,537,382 to Bartram and Wagner, disclosing the use of two types of zeolites. One comprises metal exchanged zeolites such as silver-exchanged zeolite, and the other comprises sodium zeolites. The zeolites remove, and then decompose chemical agents from the surface being decontaminated.

However, inasmuch as the above-mentioned solid-phase decontaminants are able to quickly remove CWAs from surfaces, they suffer from slow reactions with the adsorbed agents. Once contaminated, these zeolites present a persistent hazard themselves following their use. The hazard is particularly acute for VX, the most persistent and toxic of these agents, where half-lives ranging from several hours to several days (and even months) are not uncommon.

Recently, two notable improvements on absorbing and removing VX have been reported. The first by Wagner, Wu, and Kleinhammers (U.S. Pat. No. 8,317,931 "Nanotubular Titania for Decontamination of Chemical Warfare Agents"; and Wagner, G. W.; Chen, a; Wu, Y. "Reactions of VX, GD, and HD with Nanotubular Titania J. Phys. Chem. C 2008, 112, 11901-11906) discloses that VX reacts rapidly with nanotubular titania (NTT). This material affords VX half-lives on the order of several minutes (Wagner, G. W.). A second titania material, nanocrystalline titania ($nTiO_2$), exhibits an even faster VX reactivity, allowing half-lives less than 2 minutes (Wagner, G. W. "Decontamination Efficacy of Candidate Nanocrystalline sorbent with Comparison to SDS A-200 sorbent: Reactivity and Chemical Agent Resistant Coating Panel Testing" ECBC-TR-830, in press; unclassified report).

Another example is U.S. Pat. No. 8,530,719 to Peterson, disclosing a process for decontaminating surfaces contaminated with toxic agents using zirconium hydroxide ($Zr(OH)_4$), wherein the $Zr(OH)_4$ is found to be effective and rapid in decontaminating toxic agents.

Yet, another example is U.S. Pat. No. 8,658,555 to Bandosz, disclosing compositions and methods for removing toxic industrial compounds from air. Broadly, the present composition includes a mixture of hydrous metal oxide and graphite. Preferably, the hydrous metal oxide is hydrous zirconia.

Still, there remains a need in the art for even more rapid and effective method and material for decontaminating toxic agents, and the methods for rapidly and effectively removing and/or decontaminating toxic agents in an environmentally acceptable and cost-effective process.

SUMMARY OF THE INVENTION

The invention is directed towards a decontamination composition comprising at least one type of metal oxyhydroxide such as hydrated zirconium hydroxide and a carrier liquid. The invention is also directed towards a method for decontaminating or detoxifying surfaces, comprising applying the inventive composition onto surfaces contaminated with chemical warfare agents (CWAs), toxic chemicals, insecticides and the like.

BRIEF DESCRIPTION OF THE DRAWINGS

The following drawings are illustrative of embodiments of the invention and are not intended to limit the invention as encompassed by the claims forming parts of the invention.

DETAILED DESCRIPTION OF THE INVENTION

Figure 1:
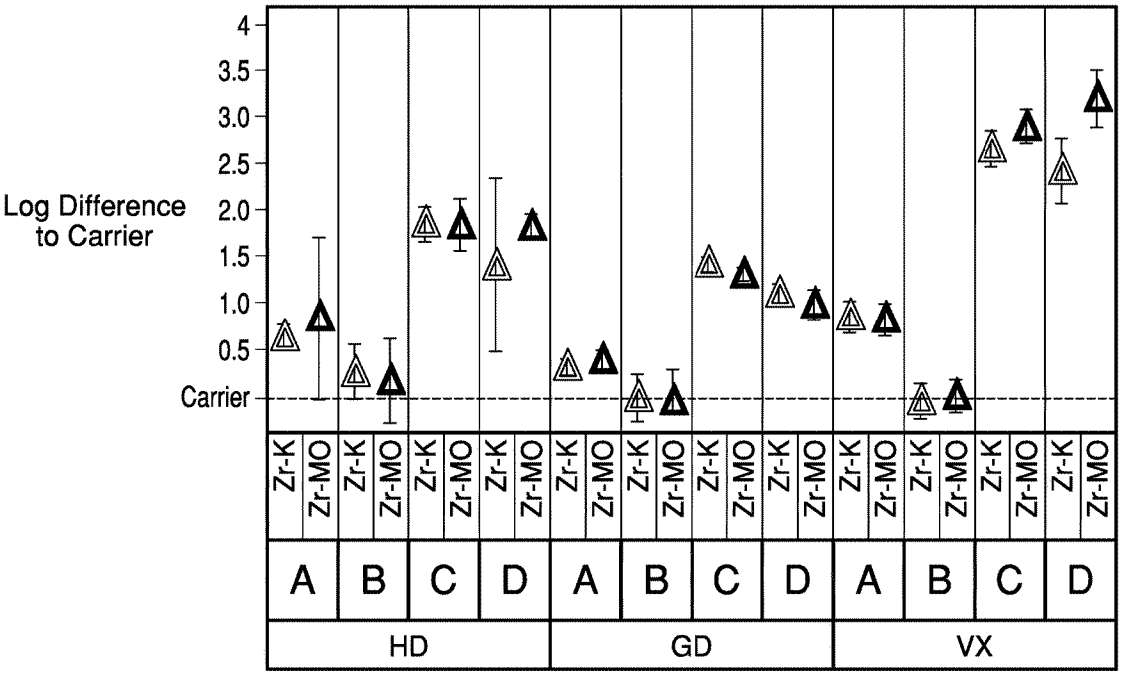
FIG. 1 illustrates test results of the $Zr(OH)_4$ decontamination composition on different surfaces contaminated with toxic agents.

The present invention relates to a decontamination mixture which has been found useful in processes for removing and subsequently detoxifying toxic materials from surfaces. The composition is comprised of at least one type of hydrated zirconium hydroxide ("$Zr(OH)_4$") admixed with a carrier fluid, wherein upon contact with the toxic materials, the half-lives of the toxic materials are rapidly and greatly reduced.

Accordingly, the invention provides novel methods for removing and detoxifying a wide range of highly toxic materials, including CW agents. In order to appreciate the scope of the invention, the terms "toxin," "toxic agent," and "toxic material," are intended to be equivalent, unless expressly stated to the contrary. In addition, the terms, "nerve gas," "nerve agent," "vesicant", "neurotoxic," and the like are intended to be equivalent, and to refer to a toxin that acts or manifests toxicity, at least in part, by disabling a component of an animal nervous system, e.g., AchE inhibitors.

In addition, the use of a term in the singular is intended to encompass its plural in the appropriate context, unless otherwise stated. In addition, reference herein to toxic agents are intended to encompass CW agents, including, e.g., bis-(2-chloroethyl)sulfide (HD or mustard gas), pinacolyl methylphosphonofluoridate (GD), Tabun (GA), Sarin (GB), cyclosarin (GF), and O-ethyl S-(2-diisopropylamino)ethyl methylphosphonothioate (VX), other toxic organophosphorus-type agents, their analogs or derivatives, and similar such art-known toxins. In addition, unless otherwise stated, the term toxic agent as used herein is also intended to include toxic industrial chemicals, including, but not limited to, organophosphorus-type insecticides, and the like.

Broadly, the novel methods provided at least one type of hydrated zirconium hydroxide, preferably, at least two types of hydrated zirconium hydroxide. Without wishing to be bound by theory, hydrated zirconium hydroxide absorbs, adsorbs, or otherwise takes up harmful toxic materials including toxic agents, and then catalytically or stoichiometrically reacts, converts, deactivates, neutralizes, or detoxifies at least a portion of the absorbed toxic agent. The term "surfaces" applies to hard surfaces such as counter tops, concrete, metals, plastic, tiles, and so forth, soft surfaces such as fabric, film, leather, carpet or upholstery, or that of human or animal skin surfaces.

Zirconium Hydroxide

Zirconium hydroxide, or hydrous zirconia is an amorphous, white powder that is insoluble in water. The structure of zirconium hydroxide or $Zr(OH)_4$, may be represented as a two-dimensional square lattice, each connected by a double hydroxyl bridge yielding a stoichiometric $Zr(OH)_4$. $Zr(OH)_4$ particles contain both terminal and bridging hydroxyl groups. Useful zirconium hydroxide may be in the form of a polymorph of zirconium hydroxide, zirconium oxyhydroxide and zirconium oxide. Dyed zirconium hydroxide that reacts to the presence of agent may also be incorporated. The $Zr(OH)_4$ may also be in amorphous state, crystalline solid, or mixture thereof. For decontamination purposes, the $Zr(OH)_4$ can either be in the form of crystalline agglomerates, non-crystalline agglomerates, or particles. If two types of $Zr(OH)_4$ are used, the first type of $Zr(OH)_4$ is in the form of crystallite agglomerates, and the second type of $Zr(OH)_4$ is in the form of particles or granules.

The type of $Zr(OH)_4$ used in the decontamination composition or slurry can be based on various characteristics including particle size, porosity, surface area, surface chemistry, and Zr to O ratio. In addition, mixtures of various types of $Zr(OH)_4$ can be used.

For example, a first type of $Zr(OH)_4$ preferably exhibits an average particle size of up to 100 nm. If not commercially available at this size range, the $Zr(OH)_4$ can be readily rendered into this size range by pulverization, milling, and the like. The first type of $Zr(OH)_4$ further exhibits a BET surface area in the range of from about 410 to 700 $m^2/g$, and more preferably from about 425 to 600 $m^2/g$. The first type of $Zr(OH)_4$ exhibits a total pore volume in the range of from about 0.2 to 0.6 $cm^3/g$, and more preferably from about 0.3 to 0.5 $cm^3/g$. The first type of $Zr(OH)_4$ also has about 15-25% of hydroxyl terminal group.

A second type of $Zr(OH)_4$ preferably exhibits an average particle size of at least 10 μm. If not commercially available at this size range, the $Zr(OH)_4$ can be readily rendered into this size range by pulverization, milling, and the like. The second type of $Zr(OH)_4$ further exhibits a Brunauer, Emmett and Teller (BET) surface area in the range of from about 200 to 550 $m^2/g$, and more preferably from about 300 to 410 $m^2/g$. The $Zr(OH)_4$ exhibits a total pore volume in the range of from about 0.6 to 1 $cm^3/g$, and more preferably from about 0.7 to 0.9 $cm^3/g$. The second type of $Zr(OH)_4$ also has about 30-50% of hydroxyl terminal group.

The total amount of zirconium hydroxide mixture is about 20-40 wt. %, preferably 25-35 wt. %, and more preferably 27-30 wt. % of the total composition. If two types of $Zr(OH)_4$ are used, the weight ratio of the first type to the second type of zirconium hydroxide is about 5:1 to 2:1, more preferably 4:1 to 2.5:1.

Optional Materials

At least one reactive and/or catalytic moiety/functional group is/are optionally incorporated onto the zirconium hydroxide. Suitable reactive moieties are selected from base metals. The suitable base metals include vanadium, chromium, manganese, iron, cobalt, nickel, copper, zinc, silver, molybdenum, and mixtures thereof. Copper, zinc, and silver are preferred. The base metal is present in the amount of about 5% to about 40% by weight of the $Zr(OH)_4$. An amount of about 15% to about 25% is also useful.

The suitable reactive moieties are also selected from amines. The suitable amines are triethylamine (TEA), quinuclidine (QUIN), triethylenediamine (TEDA), pyridine, and pyridine carboxylic acids such as pyridine-4-carboxylic acid (P4CA). Triethylenediamine is most preferred. The loading of TEDA can be as low as 0 wt. %, or as high as about 6 wt. %. A preferred amount of TEDA used is of from about 3% to about 6% by weight of the $Zr(OH)_4$.

The optional reactive moieties can be used sequentially, in combination, or as a combined mixture with porous zirconium hydroxide.

The porous zirconium hydroxide is also optionally filled uniformly or saturated with a sufficient amount of an organic solvent, while maintaining the modified $Zr(OH)_4$ in a dry, free-flowing powder form. The organic solvent occupying the pores of the $Zr(OH)_4$ can be in a liquid or solid phase.

The selection of the organic solvent can be made from any organic solvent capable of dissolving all highly toxic materials, including chemical warfare agents and remaining non-reactive with the $Zr(OH)_4$ while exhibiting sufficiently low volatility to remain on the $Zr(OH)_4$ during the decontamination phase. In a more preferred embodiment of the present invention, the organic solvent is an alkane having a chemical formula $C_nH_{2n+2}$, wherein n is at least 9, and preferably, at least 20, and combinations thereof. In a most preferred embodiment of the present invention, the organic solvent is selected from mineral oil, paraffin wax, and combinations thereof.

The amount of organic solvent present to sufficiently saturate the pores of the $Zr(OH)_4$, while maintaining the $Zr(OH)_4$ in a dry, free-flowing powder form, ranges from about 5% to 50% by weight, preferably 15% to 35% by weight, and more preferably 20% to 30% by weight based on the total weight of the modified $Zr(OH)_4$. Alternatively, the amount of the organic solvent is present in a $Zr(OH)_4$ to solvent weight proportion of about 10 parts $Zr(OH)_4$ to a range of from about 1 to 5 parts solvent, and more preferably of from about 2 to 3 parts solvent. Further information regarding $Zr(OH)_4$ impregnated by organic solvents can be found in U.S. Pat. No. 7,678,736, which is hereby incorporated by reference.

Other optional materials are, but not limited to, fragrance, surfactants, dispersants, antiseptics, soil release polymer, color-indicating materials, color speckles, colored beads, dyes, sealants, and mixtures thereof.

Carrier

The reactive $Zr(OH)_4$ is dispersed as a suspension in a suitable carrier.

Suitable carriers include polar and nonpolar solvents, e.g., water-based or organic solvent based carriers. Preferably, the carrier is prepared with sufficient viscosity to allow the composition to become sprayable and to remain on treated articles or surfaces, for a sufficient time period to remove contaminants. A useful carrier is a solvent selected from water, mineral oil, kerosene, paraffin wax, alkane having a chemical formula $C_nH_{2n+2}$ and fluorinated solvents. The carrier liquid is present in the amount of about 30-80 wt. %, preferably 45-70 wt. %, and more preferably 50-65 wt. % of the composition.

Method for Preparing the $Zr(OH)_4$

Zirconium hydroxide may be prepared by precipitating zirconium salts, such as for example zirconium oxynitrate and zirconium oxychloride, in aqueous solutions using alkaline solutions to bring about precipitation. Examples of alkaline solutions include ammonium hydroxide, potassium hydroxide and sodium hydroxide. Alternatively, zirconium hydroxide may be purchased from a commercial source such as Magnesium Elektron Inc. or MEL Chemicals of Flemington, N.J. The substrate may be in the form of a polymorph of zirconium hydroxide, zirconium oxyhydroxide and zirconium oxide.

Porous zirconium hydroxide impregnated with reactive moieties may be prepared using techniques well known to one skilled in the art. The powder (in agglomerated or non-agglomerated form) is then impregnated using ammonium solutions containing the target concentration of base metal(s) and, if desired, alkali metals. Following impregnation, the material is then dried at temperatures not to exceed about for example 200° C., and preferably not to exceed about for example 100° C., as this will bring about the dehydration of the zirconium hydroxide, reducing its porosity and also, its $Zr(OH)_4$ effectiveness.

Following drying, the impregnated material, if desired, can then be forwarded for amine, such as for example TEDA, impregnation. TEDA impregnation may be performed using techniques known to one skilled in the art. Preferably, TEDA is impregnated via a sublimation operation. For example, a known mass of the impregnated powder plus the desired amount of TEDA are loaded into a V-blender or rotating drum, for example, for the purpose of contacting the formed powder with TEDA. During the operation, TEDA will sublime into the pores of the powder over time. Heating the apparatus to temperatures on the order of about 50° C. to 100° C., for example, will speed the sublimation operation.

The TEDA containing impregnated powder is then formed into the desired geometric form, e.g. particles, beads, extrudates, etc., of the desired size using techniques known to those skilled in the art. One method is to form the powder into pills or tablets using a tableting machine. Alternatively, the powder can be pressed into large tablets, which are then crushed and sieved into particles of the desired mesh size.

A more preferred method of preparation involves impregnation of the porous $Zr(OH)_4$ in the form of a powder. This is accomplished using impregnation techniques as described above. For example, the $Zr(OH)_4$ powder is preferably dried at for example 100° C. to remove pre-adsorbed moisture. An impregnation solution is prepared by dissolving a base metal salt, e.g. carbonate in a concentrated ammonium solution. The powder is then contacted with the solution until incipient wetness is achieved. At this point, the powder is dried in an oven at for example 100° C. Once dry, the powder can be impregnated with TEDA by placing the desired amount of powder and the desired amount of TEDA in a device designed to contact the two materials, such as for example a V-blender or rotating drum. The TEDA and impregnated powder are blended for a time sufficient to allow the TEDA to sublime into the pores. The TEDA containing impregnated powder is then formed into the desired geometric form, e.g. particles, beads, extrudates, etc., of the desired size using techniques known to those skilled in the art. One method is to form the powder into pills or tablets using a tableting machine. Alternatively, the powder can be pressed into large tablets, which are then crushed and sieved into particles of the desired mesh size.

An even more preferred method of preparation involves precipitation of the metals onto the porous $Zr(OH)_4$ substrate. For example, $Zr(OH)_4$ powder is slurried in water. To the slurry is added a predetermined amount of alkali metal hydroxide, such as for example, sodium hydroxide, potassium hydroxide or lithium hydroxide. A second solution is prepared containing a base metal salt dissolved in DI water, for example zinc sulfate, zinc nitrate, zinc chloride, zinc acetate, copper sulfate, copper nitrate, copper chloride, silver nitrate, silver chloride, silver acetate, silver sulfate etc. Mixtures of salts may also be employed. The solution is then added to the slurry. The pH of the slurry is then adjusted to the target value, of between about 5 and about 13, preferably between about 7 and about 11, more preferably between about 9 and about 10. The pH adjuster is an appropriate acid, such as for example sulfuric acid, nitric acid, hydrochloric acid or formic acid. The reduction in pH will result in the base metal being precipitated onto the surface of the zirconium hydroxide substrate, likely in the form of a metal hydroxide, such as zinc hydroxide, copper hydroxide, etc. Upon completion of the precipitation, the slurry is filtered, then washed with DI water to remove any residual acid. The resulting solids are dried. The resulting dried powder may then be impregnated with TEDA as described previously. Upon completion of the TEDA impregnation operation, the resulting powder may be formed into particles as described previously using techniques known to one skilled in the art, or simply kept as a powder.

An advantage of the above mentioned precipitation procedure is that the use of ammonia can be readily avoided, so ammonia off-gassing from the $Zr(OH)_4$ will not occur.

Porous zirconium hydroxide impregnated with organic solvents may be prepared using techniques well known to one skilled in the art. Preferably the $Zr(OH)_4$ is suitably dried to remove any moisture from the surface and the pores to less than 0.5% water. The $Zr(OH)_4$ may be suitably dried by simple heating in air, inert atmosphere, or under vacuum, for example. Depending on the scale, the mixing vessel can be selected from a rotary evaporator, cone blender, ribbon mixer, "V" blender, and the like, or any device or technique suitable for contacting liquids and solids, and the actual amounts can vary in proportion to the desired scale of manufacture. Thus, each 100 g of $Zr(OH)_4$ is mixed with from about 80 to about 120 g of organic solvent, depending on the porosity of the employed $Zr(OH)_4$. For organic solvents that are solid at room temperature (e.g., paraffin wax), the organic solvent must be melted down to a liquid phase for impregnating the $Zr(OH)_4$. Once in the vessel, the organic solvent in liquid phase is contacted with the $Zr(OH)_4$ under an inert atmosphere (e.g., dry $N_2$) until incipient wetness is achieved. Alternatively, the $Zr(OH)_4$ can be contacted with the organic solvent by spraying, dripping and the like.

Once the impregnation step is complete, at least a portion of the excess organic solvent is evaporated. In particular, the excess organic solvent is evaporated from the $Zr(OH)_4$ such that the resulting $Zr(OH)_4$ has from about 10% to about 100% of the pore volume filled with the organic solvent, and preferably from about 50 to about 90% of the pore volume filled.

At least one type of $Zr(OH)_4$, preferably, at least two types of $Zr(OH)_4$ present in an amount up to 40 wt. %, suspended in 5-15% of water, and a carrier fluid in the amount of 50-70% is then added to the $Zr(OH)_4$-water mixture to form a decontamination slurry.

Method for Decontaminating Surfaces

In carrying out the process of the invention, the $Zr(OH)_4$ slurry is sprayed onto a contaminated surface that is intended to be detoxified or rendered free of toxic agents.

The decontamination operation can take place over a wide range of temperatures and humidity values consistent with ambient conditions. For example, the contacting step can be carried out at a temperature of from about −40° C. to about 70° C., preferably about 10° C. to about 45° C. The relative humidity can be as low as less than 10% to greater than 90%.

It is preferred that the $Zr(OH)_4$ be allowed to contact the contaminated surfaces for at least about 0.5 minutes, preferably from about 1-480 minutes, and more preferably from about 240 minutes.

The methods of the present invention for decontaminating surfaces can be carried out by spraying, rubbing, brushing, dipping, dusting, or otherwise contacting the $Zr(OH)_4$ slurry of the invention with a surface or composition that is believed to be in need of such treatment. Upon contact, the toxic agents are detoxified within the pores of the $Zr(OH)_4$, after their half-lives have been reduced to an acceptable level.

The artisan will appreciate that selection of the form in which the inventive composition is dispersed will depend upon the physical form of the contaminant(s), the nature of the terrain and/or equipment or personal needing decontamination, and the practical needs of distribution and removal of the used or spent $Zr(OH)_4$.

For purposes of the present invention, it will be understood by those of ordinary skill in the art that the term "sufficient", as used in conjunction with the terms "amount", "time" and "conditions" represents a quantitative value that provides a satisfactory and desired result, i.e., detoxifying toxic agents or decontaminating surfaces, which have been in contact with toxic agents. The amounts, conditions and time required to achieve the desired result will, of course, vary somewhat based upon the amount of toxic agent present and the area to be treated. For purposes of illustration, the amount of $Zr(OH)_4$ required for decontaminating a surface is generally, at minimum, an amount that is sufficient to cover the affected area surface. The time required for achieving a satisfactory detoxification or neutralization of toxic agents is in the range of about less than 30 seconds to about 3 hours.

One of ordinary skills in the art would appreciate that the present invention can be use by military personnel, police officers, firefighters, or other first responders in government, civil, private, or commercial settings.

EXAMPLE 1

An octuplicate of liquid sample at 1 g/mL was prepared from VX, GD and HD. A set of duplicate of the octuplicate for each toxic agent was respectively applied onto a different surface: "Polyurethane-based", "alloyed-based", "polyethylene", and "stainless steel." The surfaces were accordingly labeled as "A", "B", "C" and "D" in FIG. 1.

The agent was allowed to settle onto each of the tested surfaces for 15 minutes, at which point a zirconium hydroxide slurry containing 23% first type, 6% second type, 10% water, and 60% kerosene ("Zr—K") was applied using a positive displacement pipette onto one of the two duplicated contaminated surfaces. A zirconium hydroxide slurry containing 23% first type, 6% second type, 10% water, and 60% mineral oil ("Zr-MO") was applied using a positive displacement pipette onto the second of the two duplicated contaminated surfaces. The decontaminant remained on the surface for a period of 4 hours. After the decontamination process, the surface was rinsed and extracted immediately using analytical solvent to determine the amount of residual agent is in the surface after contact with the decontamination slurry. When $Zr(OH)_4$ was present, quenching of the reactivity was conducted using glacial acetic acid to ensure that the reaction did not continue during the extraction. As a control, the carrier liquid alone was evaluated for decontaminant efficacy.

FIG. 1 illustrates the performance comparison of a single formulation of the $Zr(OH)_4$ slurry decontaminant compared to the carrier liquid (dotted line). Log difference ("LD") is a relative metric used to compare the performance of decontaminants to control conditions. A LD of 1 equates to 90% better efficacy than the control (LD of 2 equates to a 99% better efficacy, etc.). For the majority of contaminant-material combinations, the $Zr(OH)_4$ slurry performed demonstrated improved efficacy when compared to the carrier liquid.

Figure 2:
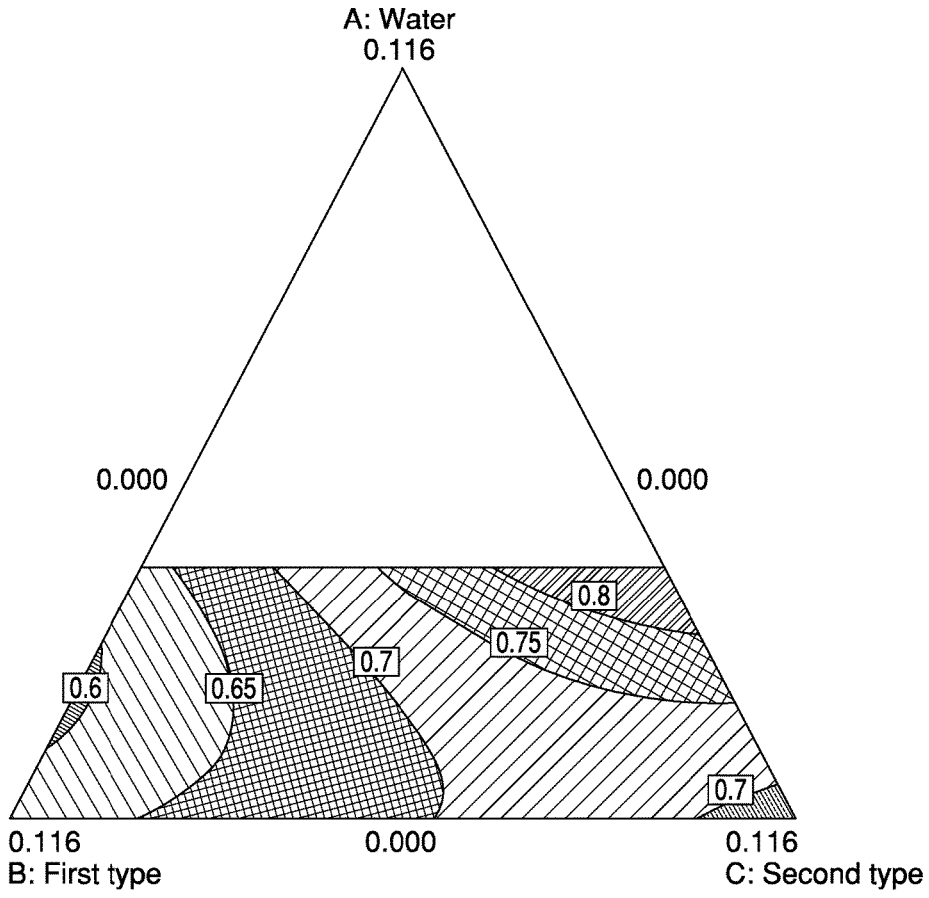
FIG. 2 illustrates a ternary plot of optimal mixture of two different types of $Zr(OH)_4$ for decontamination.

FIG. 2 illustrates a ternary plot where each of the three sides of the triangle represent a different reactive component of the decontaminant slurry (Type B $Zr(OH)_4$ (bottom), type C $Zr(OH)_4$ (right), and water (left). The carrier liquid is not represented on the plot, but is present in the mixtures. Each point on the plot equates to a combination of the three components. The gray region of the plot illustrates combinations that are not possible due to application challenges. The shaded regions of the plot indicate decontaminant desirability (0-1). Darker shades indicate higher decontaminant desirability. For GD, the experimental design predicts a decontaminant slurry formulation that favors the second type $Zr(OH)_4$ (10% by mass) over the first type (0%), with added water (5% by mass) and carrier liquid (85% by mass) for maximum efficacy on all tested materials.

The invention claimed is:

1. A process for decontaminating surfaces contaminated with at least one toxic agent, comprising applying onto said contaminated surfaces a decontamination composition comprising an aqueous or non-aqueous carrier liquid and at least two types of $Zr(OH)_4$ including a first type $Zr(OH)_4$ and a second type $Zr(OH)_4$, wherein said first type $Zr(OH)_4$ has an average particle size of up to 100 nm and said second type $Zr(OH)_4$ has an average particle size of at least 10 μm, and wherein said decontamination composition has a weight ratio of said first type $Zr(OH)_4$ to said second type $Zr(OH)_4$ in the range of about 5:1 to 2:1.

2. The process of claim 1, wherein said first type $Zr(OH)_4$ is in the form of crystalline agglomerates and said second type $Zr(OH)_4$ is in the form of particles or granules.

3. The process of claim 1, wherein said decontamination composition has a weight ratio of said first type $Zr(OH)_4$ to said second type $Zr(OH)_4$ in the range of about 4:1 to 2.5:1.

4. The process of claim 1, wherein said first type $Zr(OH)_4$ has a BET surface area of about 425 to 600 $m^2/g$, a total pore volume in the range of about 0.3 to 0.5 $cm^3/g$, and about 15-25% of hydroxyl terminal groups.

5. The process of claim 1, wherein said second type $Zr(OH)_4$ has a BET surface area of about 300 to 410 $m^3/g$, a total pore volume in the range of about 0.6 to 1 $cm^3/g$, and about 30-50% of hydroxyl terminal groups.

6. The process of claim 1, wherein said first and second type of zirconium hydroxide is present in the amount of 20-40 wt. % of said decontamination composition.

7. The process of claim 1, wherein said carrier liquid is selected from water, mineral oil, kerosene, paraffin wax, alkanes having a chemical formula $C_nH_{2n+2}$ and fluorinated solvents.

8. The process of claim 1, wherein said carrier liquid is present in the amount of 45-70 wt. % of said decontamination composition.

9. The process of claim 1, wherein said composition further includes additional metal oxyhydroxides.

10. The process of claim 1, wherein said at least one toxic agent is an organophosphorus-based ("OP") compound, and wherein said organophosphorus-based compound is a chemical warfare agent selected from pinacolyl methylphosphonofluoridate (GD), Tabun (GA), Sarin (GB), cyclosarin (GF), O-ethyl S-(2-diisopropylamino)ethyl methylphosphonothioate (VX), and analogs and derivatives thereof, or an insecticide selected from parathion, paraoxon, and malathion.

11. The process of claim 1, wherein said decontaminant is applied via a spray application.

* * * * *